US006687934B1

(12) United States Patent
Liao

(10) Patent No.: US 6,687,934 B1
(45) Date of Patent: Feb. 10, 2004

(54) SEAT CUSHION STRUCTURE

(76) Inventor: Tsun-Chi Liao, 1F, No. 7, Lane 545, Sec. 2, Chun-Kung Rd., Chun-Kung Li, Taichung (TW)

( * ) Notice: Subject to any disclaimer, the term of this patent is extended or adjusted under 35 U.S.C. 154(b) by 0 days.

(21) Appl. No.: 10/214,152

(22) Filed: Aug. 8, 2002

(51) Int. Cl.[7] ..... A47C 7/18; A47C 27/14; A47C 27/18

(52) U.S. Cl. ..... 5/654; 5/653; 5/737; 297/195.1; 297/452.26

(58) Field of Search ..... 5/653, 654, 737; 297/195.1, 202, 452.26

(56) References Cited

U.S. PATENT DOCUMENTS 2,384,713 A * 9/1945 Varma ..... 297/452.26
3,243,231 A * 3/1966 Duffy ..... 297/202
3,337,884 A * 8/1967 Meier ..... 297/452.26
4,753,480 A * 6/1988 Morell ..... 5/653
4,788,730 A * 12/1988 Bexton ..... 5/654
5,189,747 A * 3/1993 Mundy et al. ..... 5/654
5,348,369 A * 9/1994 Yu ..... 297/195.1
5,687,436 A * 11/1997 Denton ..... 5/654
5,836,025 A * 11/1998 Poncy, Sr. ..... 5/654
5,933,891 A * 8/1999 Nachod, III ..... 5/654
6,125,486 A * 10/2000 Rabon ..... 5/654
2002/0163231 A1 * 11/2002 Hoshino ..... 297/195.1

* cited by examiner

*Primary Examiner*—Alexander Grosz
(74) *Attorney, Agent, or Firm*—Birch, Stewart, Kolasch & Birch, LLP

(57) ABSTRACT

A seat cushion structure of the invention comprises a cushion body, made of a foamed material, that has a top surface provided with two left and right recessed cavities. A flexible filling material is filled within the recessed cavities of the cushion body. A covering skin is stretched to outwardly cover the flexible filling material and the cushion body, wherein an air gap is left between the flexible filling material and the covering skin. With the above seat cushion structure, comfortable seating and good heat dissipation are provided.

4 Claims, 5 Drawing Sheets

SEAT CUSHION STRUCTURE

FIELD OF THE INVENTION

The invention relates to a seat cushion structure and, more particularly, to a seat cushion structure that can provide comfortable seating and good heat dissipation.

BACKGROUND OF THE INVENTION

As shown in FIG. 1, a conventional stool is usually provided with flexible cushion 1 that has an upper surface on which the buttocks of the user rest. The cushion 1 is conventionally made of a foamed material 2 that is outwardly covered with a covering skin 3. If the user seats on the cushion 1 for a long time, the heat from the user's body is progressively transferred to the foamed material 2 of the cushion 1. If the covering skin 3 is made of synthetic leather, it is not air permeable. When the user sits on the cushion 1 for a long time, the heat is therefore accumulated at the contact interface, which causes uncomfortable sweating.

The above disadvantages are exacerbated when the user while being seated is moving. This occurs when the user is, for example, a drummer who is practicing. The consequent movement of the drummer's buttocks creates frictional contacts and increases the production of heat. Furthermore, the upper planar surface of the cushion 1 is usually not adapted to the curved profile of the profile of the user's buttocks. As a result, the support of the user's weight is substantially concentrated at a limited contact area of the cushion 1, which causes fatigue during prolonged seating time.

SUMMARY OF THE INVENTION

Accordingly, it is a principal object of the invention to provide a seat cushion structure that can provide comfortable seating and good heat dissipation.

To attain the above and other objectives, a seat cushion structure of the invention comprises a cushion body, made of a foamed material, that has a top surface provided with two recessed cavities. A flexible filling material is filled within the recessed cavities of the cushion body. A covering skin is stretched to outwardly cover the flexible filling material and the cushion body, wherein an air gap is left between the flexible filling material and the covering skin.

With the above seat cushion structure, comfortable seating is provided. Furthermore, an air gap is maintained between the covering skin and the filling material even when the user is moving, which therefore improves the heat dissipation.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
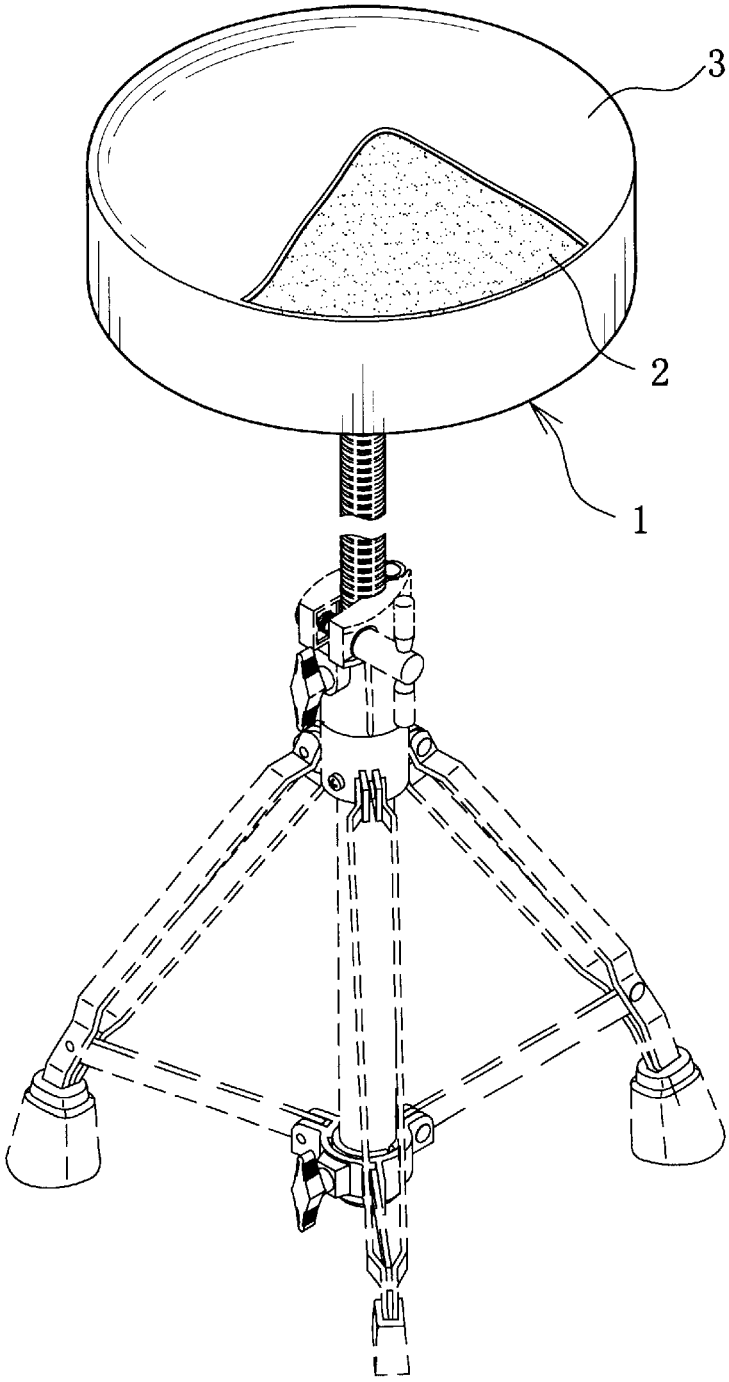
Fig. 1 Prior Art
FIG. 1 is a perspective view schematically illustrating a seat cushion structure of the prior art.

Wherever possible in the following description, like reference numerals will refer to like elements and parts unless otherwise illustrated.

Figure 2:
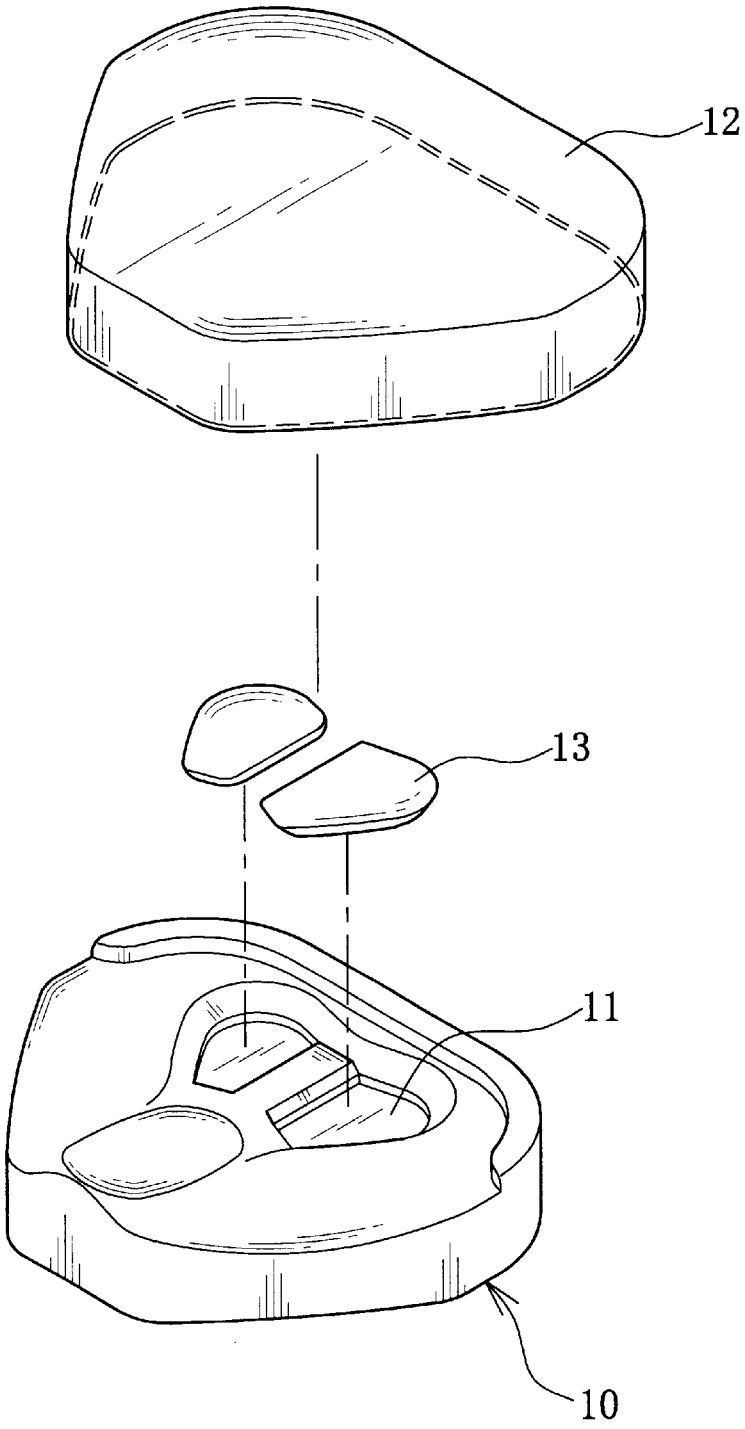
FIG. 2 is an exploded view schematically illustrating a seat cushion structure according to an embodiment of the invention.

Now referring to FIG. 2, the invention provides a seat cushion structure that comprises a cushion body 10 made of polyurethane (PU) foamed material. At the left and right sides of the top surface of the cushion body 10 are respectively formed recessed cavities 11 that respectively have a profile compliant to the profile of the user's buttocks. A covering skin 12 made of, for example, leather material, is stretched to outwardly cover the cushion body 10, the covering skin 12 being partially in contact with the top surface of the cushion body 10. The recessed cavities 11 are filled with a flexible filling material 13 made of, for example, silicon resin that has a top surface spaced away from the covering skin 12 by an air gap L (see FIG. 4).

Figure 3:
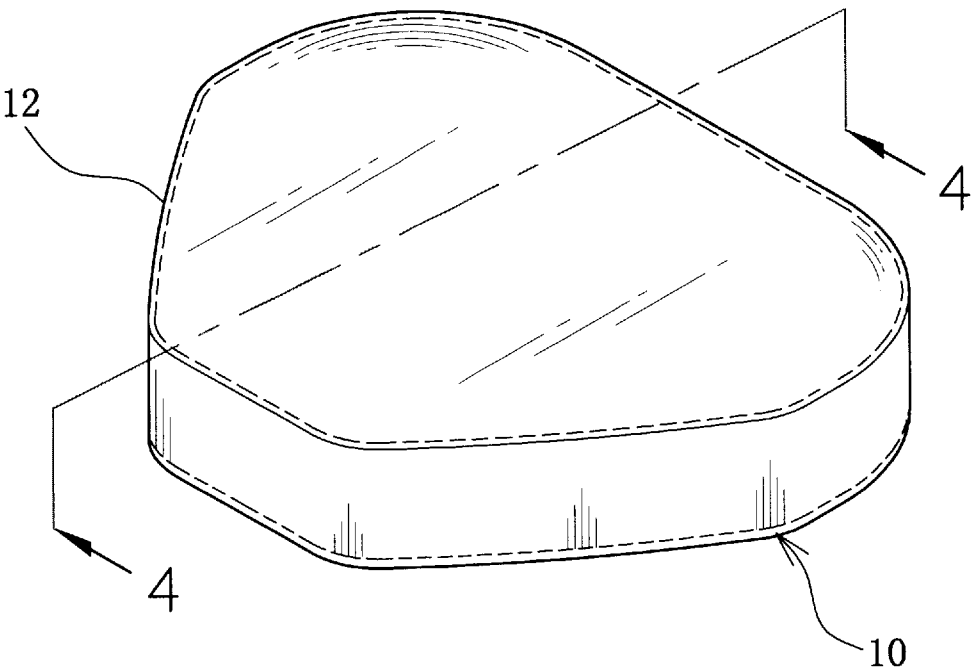
FIG. 3 is a perspective view schematically showing the external aspect of a seat cushion structure according to an embodiment of the invention.
Figure 4:
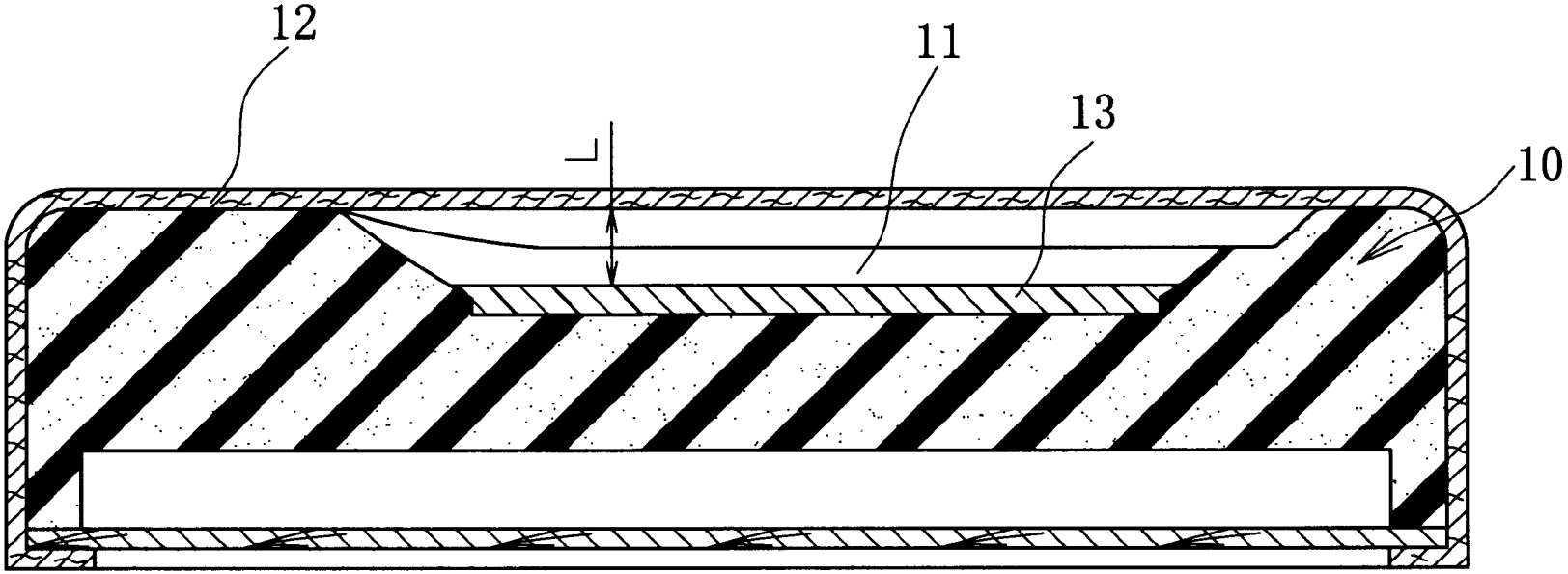
FIG. 4 is a cross-sectional view taken along the section 4—4 of FIG. 3.

Referring to FIG. 3 and FIG. 4, when the user seats on the cushion body 10, due to the user's weight, his/her buttocks are received within the recessed cavities 11 and the filling material 13 flexibly matches with the profile of the buttocks. Comfortable seating is therefore provided via an increased contact surface area. The covering skin 12 is preferably air-permeable and further provided with adequate elastic properties so that it is capable of stretching and contacting with the filling material 13 under pressure of the user's weight even if the user's buttocks are moved on the cushion body 10. The movement of the user's buttocks may be significant in certain situations such as when the user is a drummer who is practicing, in which case the cushion structure of the invention provides more particularly comfortable seating.

When no pressure is exerted thereon, the covering skin 12 is further capable of separating from the surface of the filing material 13 to substantially restore the air gap L there between. The air gap therefore provided, even when the covering skin 12, under pressure of the user's weight, stretches and contacts with the filling material 13, can dissipate the heat from the user's body transmitted through the seat contact to the cushion body 10. Furthermore, the heat is all the more rapidly dissipated as the filing material 13, made of polyurethane, does not easily retain heat, which promotes heat dissipation through the air gap and the air-permeable covering skin 12. Therefore, a cool and comfortable feeling is obtained when the user sits on the cushion body 10.

Figure 5:
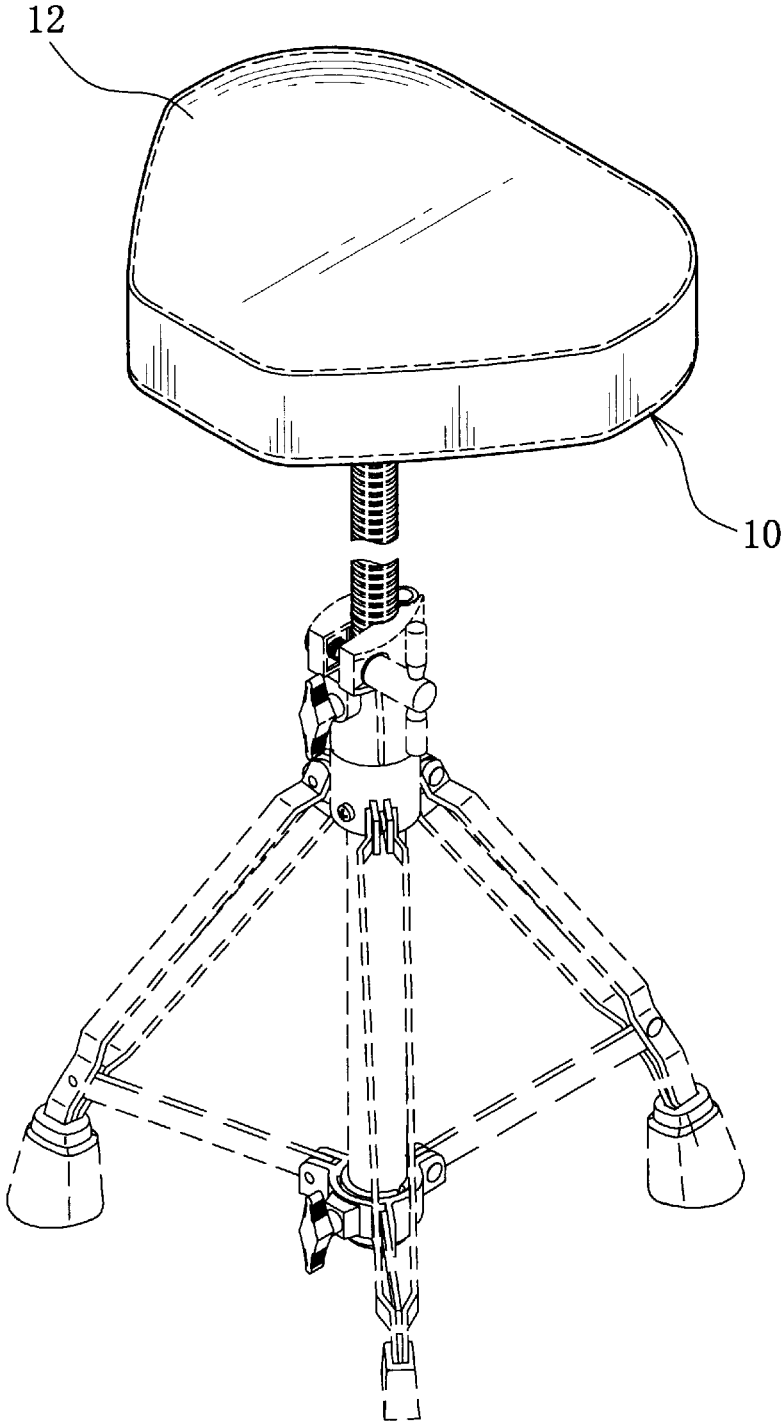
FIG. 5 is a perspective view schematically illustrating the assembly of the seat cushion structure of the invention a stool.

It should be noticed that the two recessed cavities 11 are designed in accordance with the profile of the human buttocks and their specific curvature, which therefore enables an optimal pressure distribution of the user's weight at the contact interface with the cushion body 10. As shown in FIG. 5, the foamed material of the cushion body 10, formed in a single body, is relatively cheap and further is sufficiently hard to be capable of supporting the user's weight without substantial deformation. Although the filling material 13, preferably made of silicon resin, is relatively more expensive, its amount in the entire seat cushion structure is however reduced compared with the foamed material of cushion body 10. The seat cushion structure of the invention can be therefore produced with a relatively low manufacture cost.

As described above, the invention therefore provides a seat cushion structure that can economically provide comfortable seating and good heat dissipation characteristics. The seat cushion structure comprises a cushion body that is provided with two recessed cavities formed in accordance with the profile of the human buttocks. The recessed cavities are filled with a filling material, and both cushion body and filling material are outwardly covered with a covering skin, wherein an air gap is left between the filling material and the covering skin.

To achieve comfortable seating, the material of the filling material is preferably made of silicon resin. However, the use of other types of material may be also envisaged for the filling material such as sponge materials.

Those skilled in the art will readily appreciate that the above description is only illustrative of specific embodiments and examples of the invention. The invention should therefore cover various modifications and variations made to the structure of the invention described herein, provided they are included within the scope of the invention as defined in the following appended claims.

What is claimed is:

1. A seat cushion structure, comprising:

a cushion body, made of a foamed material, a top of the cushion body being provided with at least a recessed cavity that has a profile compliant to a profile of human buttocks;

a flexible filling material, filled within the recessed cavity of the cushion body; and an elastic covering skin, outwardly covering the flexible filling material and the cushion body, an air gap being between the flexible filling material and the covering skin, the air gap being compressed when the seat cushion structure is in use and being restored when the seat cushion structure is vacant, the covering skin being sufficiently elastic to stretch and contact the filling material under the pressure of a user's weight, and separating from the filling material when no pressure of a user's weight is exerted thereon.

2. The seat cushion structure of claim 1, wherein the flexible filling material is made of silicon resin.

3. The seat cushion structure of claim 1, wherein the covering skin is made of a leather that has adequate elastic properties to be capable of stretching when a user seats on the seat cushion structure.

4. The seat cushion structure of claim 1, wherein the top of the cushion body is provided with two recessed cavities.

* * * * *